United States Patent [19]

Matsuura et al.

[11] Patent Number: 4,606,987

[45] Date of Patent: Aug. 19, 1986

[54] HYDRAZONE OR SEMICARBAZONE ELECTROPHOTOGRAPHIC PHOTOSENSITIVE MATERIAL

[75] Inventors: Kazuo Matsuura, Kusatsu; Hiroki Osedo; Keisuke Ohshima, both of Ohtsu, all of Japan

[73] Assignee: Toray Industries, Inc., Tokyo, Japan

[21] Appl. No.: 753,187

[22] Filed: Jul. 9, 1985

[30] Foreign Application Priority Data

Jul. 10, 1984 [JP] Japan ..... 59-142593
Jul. 10, 1984 [JP] Japan ..... 59-142594

[51] Int. Cl.[4] ..... G03G 5/06; G03G 5/14

[52] U.S. Cl. ..... 430/59; 430/58; 430/70; 430/71; 430/72; 430/73; 430/74; 430/75; 430/76; 430/77; 430/78; 430/79; 564/36; 564/250; 564/251

[58] Field of Search ..... 430/58, 59, 70, 71, 430/72, 73, 74, 75, 76, 77, 78, 79

[56] References Cited

U.S. PATENT DOCUMENTS 3,066,023 11/1962 Schlesinger et al. ..... 430/74 X
4,278,747 7/1981 Murayama et al. ..... 430/73 X

FOREIGN PATENT DOCUMENTS 58-52647 3/1983 Japan ..... 430/58
59-195247 11/1984 Japan ..... 430/74
60-4557 1/1985 Japan ..... 430/74

*Primary Examiner*—Roland E. Martin
*Attorney, Agent, or Firm*—Austin R. Miller

[57] ABSTRACT

An electrophotographic photosensitive material has a photosensitive layer formed on an electroconductive substrate, with the photosensitive layer containing a polymeric binder and an organic photoconductor represented by the following formula $$A-(CH=CH)_nCH=NNHY$$

wherein A is selected from the group consisting of an alkyl group having 1 to 12 carbon atoms, an aralkyl group having 7 to 14 carbon atoms, an aryl group having 6 to 20 carbon atoms and a heterocyclic residue of a 3- to 30- membered ring, wherein n is 1 or 2, Y is selected from the group consisting of $-SO_2R'$, $$-\overset{\overset{\displaystyle x}{\|}}{C}NR^2R^3,\ -\overset{\overset{\displaystyle x}{\|}}{C}N=CR^2R^3$$

$$-\overset{\overset{\displaystyle x}{\|}}{C}N=CH-(CH=CH)_mB\ \ -\overset{\overset{\displaystyle x}{\|}}{C}NHNR^4R^5,$$

$$-\overset{\overset{\displaystyle x}{\|}}{C}NHN=CR^4R^5,\ \text{or}\ -\overset{\overset{\displaystyle x}{\|}}{C}NHN=CH(CH=CH)_m-B,$$

wherein R′ is selected from the group consisting of an alkyl group having 1 to 12 carbon atoms, an aralkyl group having 7 to 14 carbon atoms, an aryl group having 6 to 20 carbon atoms and a heterocyclic residue of a 3- to 30- membered ring, and $R^2$ and $R^3$, $R^4$ and $R^5$, either form a ring together with the nitrogen atom to which $R^2$ and $R^3$, $R^4$ and $R^5$ are bonded and in this case $R^2$ and $R^3$, $R^4$ and $R^5$ independently signify (1) a carbon atom, or (2) at least one atom selected from the group consisting of an oxygen atom, a nitrogen atom, and a sulfur atom which is included in the same ring, or $R^2$ and $R^3$, $R^4$ and $R^5$ are not included in the same ring and in this case $R^2$ and $R^3$, $R^4$ and $R^5$ independently signify a hydrogen atom, an alkyl group having 1 to 12 carbon atoms, an aralkyl group having 7 to 14 carbon atoms, an aryl group having 6 to 20 carbon atoms or a heterocyclic residue of a 3- to 30- membered ring, B is selected from the group consisting of an alkyl group having 1 to 12 carbon atoms, an aralkyl group having 7 to 14 carbon atoms, an aryl group having 6 to 20 carbon atoms or a heterocyclic residue of a 3- to 30- membered ring, x is an oxygen atom or a sulfur atom, m is 1 or 2, and wherein $R^1$ through $R^5$, A and B may be either substituted or not substituted.

19 Claims, No Drawings

HYDRAZONE OR SEMICARBAZONE ELECTROPHOTOGRAPHIC PHOTOSENSITIVE MATERIAL

BACKGROUND OF THE INVENTION

1. Field of the Invention

This invention relates to an electrophotographic photosensitive material. More particularly, it relates to an electrophotographic photosensitive material comprising a photosensitive layer containing an organic photoconductor and a polymeric binder.

2. Description of the Art

Organic photoconductors are advantageous over inorganic photoconductors in that they are light in weight, possess good flexibility, provide photosensitive layers excellent in transparency and can easily be combined into a composite material with other materials. Polyvinyl carbazoles, oxadiazoles and pyrazoline derivatives are known as such organic photoconductors.

Basic properties required for electrophotographic photosensitive materials are high static charge acceptance and high charge retentivity in the dark, a high sensitivity, a low residual voltage, a broad spectral sensitivity in the visible region, a high durability, no toxicity, and good processabilities (including a good film-forming property, a high transparency, a high flexibility and a good adaptability to the mass production). Organic photoconductors and inorganic photoconductors, which are satisfactory in all of these basic properties when they are used alone, have not heretofore been proposed. Thus, photoconductors popularly used at present have some defects or others.

Under this circumstance, function-separated electrophotographic photosensitive materials have recently been proposed. These photosensitive materials are based on the concept that the photosensitive layer is divided into layers differing in the function, that is, a charge generating layer for generating charges on absorption of light and a charge transport layer for transporting the formed charges, whereby the range for the selection of materials is broadened and some or all of the basic properties required for electrophotographic photosensitive materials are sufficiently manifested. Many function-separated electrophotographic photosensitive materials have heretofore been proposed, but only a limited number of them have been put into practical use. The practically used photosensitive materials still have some defects or others.

The combination of a charge generating material and a charge transport material has not theoretically been examined, but various combinations have been examined according to trial-and-error procedures.

The U.S. Pat. to Matsumura et al No. 4,463,077 discloses an electrophotographic photosensitive material having an organic photoconductor based upon the $>C{=}N{-}N<$ structure and which differs sharply from the organic photoconductors disclosed and claimed herein.

SUMMARY OF THE INVENTION

It is therefore a primary object of the present invention to provide an electrophotographic material which is excellent in the charge acceptance and charge retentivity in the dark place and has a high sensitivity as well as good durability.

Another object of the present invention is to provide an electrophotographic photosensitive material comprising an organic photoconductor obtained from a starting material having a much higher safety than that of the starting material for the known hydrazone and pyrazoline derivatives.

Still another object of the present invention is to provide a photosensitive layer comprising a polymeric binder and an organic photoconductor having an enhanced compatibility with the polymeric binder.

DESCRIPTION OF THE PREFERRED EMBODIMENTS

In accordance with this invention an electrophotographic photosensitive material is provided comprising a photosensitive layer formed on an electroconductive substrate. The photosensitive layer contains a polymeric binder and an organic photoconductor represented by the formula (I):

$$A\text{-}(CH{=}CH)_n CH{=}NNHY \qquad (I)$$

wherein A is an alkyl group, having 1 to 12 carbon atoms, an aralkyl group of 7 to 14 carbon atoms, an aryl group having 6 to 20 carbon atoms or a heterocyclic residue of a 3 to 30 membered ring, n is 1 or 2, Y is $-SO_2R'$ $$-\overset{\overset{X}{\|}}{C}NR^2R^3 \quad -\overset{\overset{X}{\|}}{C}N{=}CR^2R^3$$

$$-\overset{\overset{X}{\|}}{C}N{=}\overset{\overset{H}{|}}{C}\text{-}(CH{=}CH)_m\text{-}B \quad -\overset{\overset{X}{\|}}{C}NHNR^4R^5$$

$$-\overset{\overset{X}{\|}}{C}NHN{=}CR^4R^5, \text{ or } -\overset{\overset{X}{\|}}{C}NHN{=}CH\text{-}(CH{=}CH)_m\text{-}B$$

(wherein R′ is an alkyl group having 1 to 12 carbon atoms, an aralkyl group of 7 to 14 carbon atoms, an aryl group having 6 to 20 carbon atoms or a heterocyclic residue of a 3 to 30 membered ring, and $R^2$ and $R^3$, $R^4$ and $R^5$, either form a ring together with the nitrogen atom to which $R^2$ and $R^3$, $R^4$ and $R^5$ are bonded and in this case $R^2$ and $R^3$, $R^4$ and $R^5$ independently signify (1) a carbon atom, or (2) at least one atom selected from the group consisting of an oxygen atom, a nitrogen atom and a sulfur atom which is included in the same ring, or $R^2$ and $R^3$, $R^4$ and $R^5$ are not included in the same ring and in this case $R^2$ and $R^3$, $R^4$ and $R^5$ independently signify a hydrogen atom, an alkyl group having 1 to 12 carbon atoms, an aralkyl group having 7 to 14 carbon atoms, an aryl group having 6 to 20 carbon atoms or a heterocyclic residue of a 3 to 30 membered ring, B is an alkyl group having 1 to 12 carbon atoms, an aralkyl group having 7 to 14 carbon atoms, an aryl group having 6 to 20 carbon atoms or a heterocyclic residue of a 3 to 30 membered ring, X is an oxygen atom or a sulfur atom, m is 1 or 2.

Among the compounds useful as the organic photoconductor are:

(1) A sulfonyl hydrazone compound represented by the following general formula (a) (hereinafter referred to as "compound (1)" for brevity):

$$A\text{-}(CH{=}CH)_n CH{=}NHN{-}\overset{\overset{O}{\|}}{\underset{\underset{O}{\|}}{S}}{-}R' \quad (a)$$

wherein each of A and $R^1$ is an alkyl group, an aralkyl group, an aryl group or a heterocyclic residue.

(2) A semicarbazone compound represented by the following general formula (b), (c) or (d) (hereinafter referred to as "compound (2)" for brevity):

$$A\text{-}(CH{=}CH)_n CH{=}NNH\overset{\overset{X}{\|}}{C}NR^2R^3 \quad (b)$$

$$A\text{-}(CH{=}CH)_n CH{=}NNH\overset{\overset{X}{\|}}{C}N{=}CR^2R^3 \quad (c)$$

$$A\text{-}(CH{=}CH)_n CH{=}NNH\overset{\overset{X}{\|}}{C}N{=}CH\text{-}(CH{=}CH)_m B \quad (d)$$

A, $R^2$, $R^3$, X, n and m represent the same thing as mentioned before. (3) A carbohydrazone compound represented by the following general formula (e), (f) or (g) [hereinafter referred to as "compound (3) for brevity]:

$$A\text{-}(CH{=}CH)_n CH{=}NNH\overset{\overset{X}{\|}}{C}NHNR^4R^5 \quad (e)$$

$$A\text{-}(CH{=}CH)_n CH{=}NNH\overset{\overset{X}{\|}}{C}NHN{=}CR^4R^5 \quad (f)$$

-continued $$A\text{-}(CH{=}CH)_n NNH\overset{\overset{X}{\|}}{C}NHN{=}CH\text{-}(CH{=}CH)_m B \quad (g)$$

A, $R^4$, $R^5$, X, n and m represent the same thing as mentioned before.

In the above compounds (1) through (3) the R groups may have substituents. As the alkyl and alkylene groups, those having 1 to 12 carbon atoms are preferable. As the aralkyl and aralkylene groups, those having 7 to 14 carbon atoms are preferable. As the aryl and arylene groups, those having 6 to 20 carbon atoms are preferable. As the heterocyclic residue, 3- to 30-membered heterocyclic residues containing nitrogen, oxygen or sulfur as ring constituents are preferable. For example, pyrrole, pyrazole, pyrazoline, imidazole, triazole, pyridine, pyrimidine, pyrazine, triazine, indole, quinoline, quinazoline, phthalazine, carbazole, acridine, phenazine, furan, pyran, benzofuran, thiophene, benzothiophene, thiazine, thiadiazole, imidazolone and imidazothione, oxazole, benzoxazole, oxadiazole, thiazole, benzothiazole, carbostyril can be mentioned. As the substituent, there can be mentioned alkyl groups such as methyl, ethyl and propyl groups; alkoxy groups such as a methoxy group; halogen atoms such as fluorine, chlorine, bromine and iodine; amino groups such as amino, methylamino, ethylamino, propylamino, dimethylamino, diethyamino and benzylamino groups; a hydroxyl group; acyl groups such as acetyl group; alkylthio groups such as methylthio and ethylthio; and a thiol group.

Preferred examples of sulfonylhydrazone compounds of this invention ("compound 1") include:

(1-1)

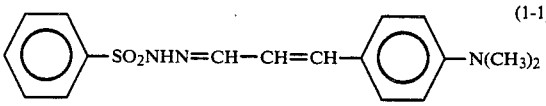

(1-2)

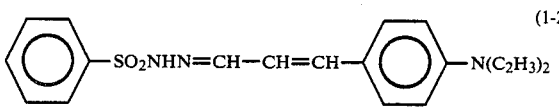

(1-3)

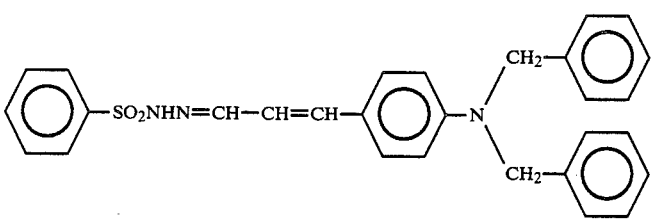

(1-4)

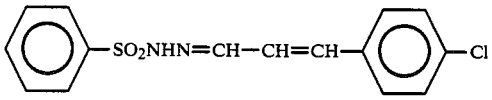

(1-5)

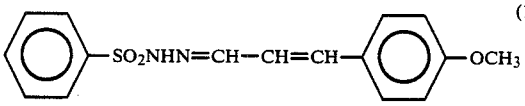

(1-6)

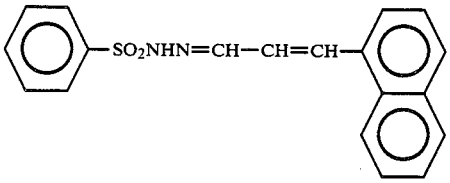

(1-7)

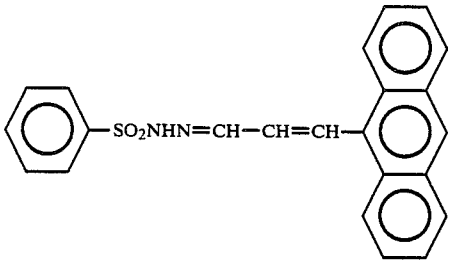

-continued
(1-8)
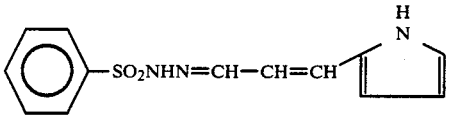
(1-9)
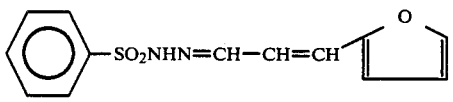
(1-10)
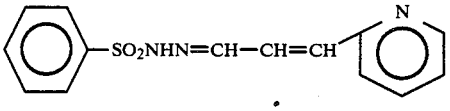
(1-11)
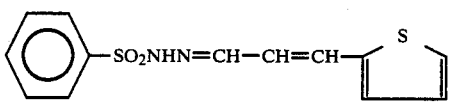
(1-12)
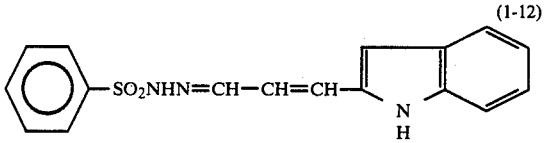
(1-13)
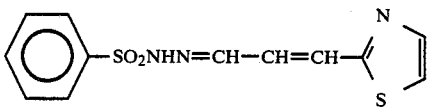
(1-14)
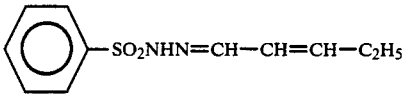
(1-15)
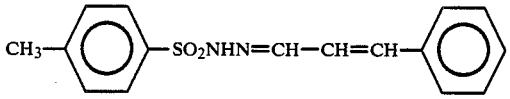
(1-16)
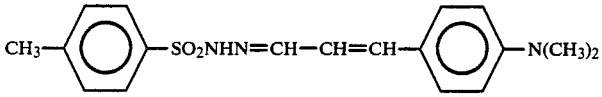
(1-17)
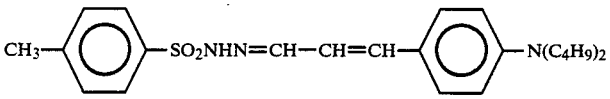
(1-18)
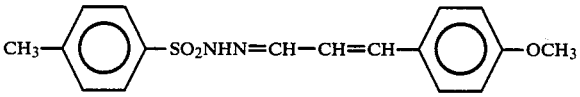
(1-19)
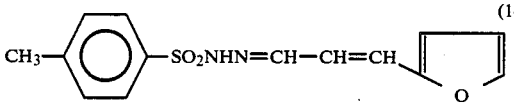
(1-20)
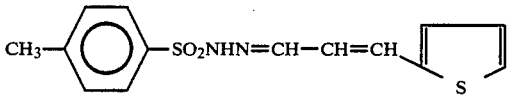
(1-21)
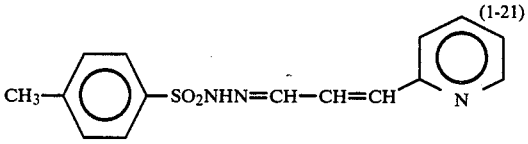
(1-22)
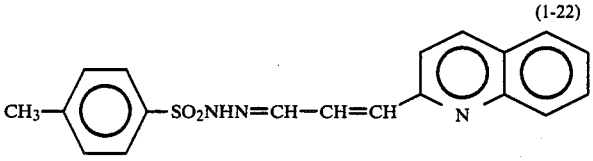
(1-23)
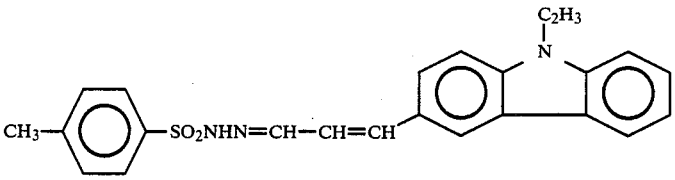
(1-24)
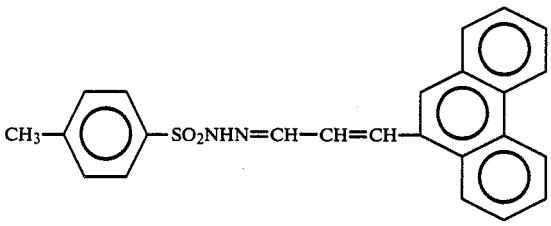
(1-25)
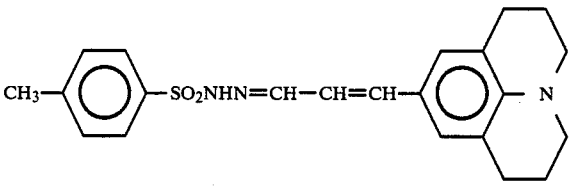

-continued (1-26)

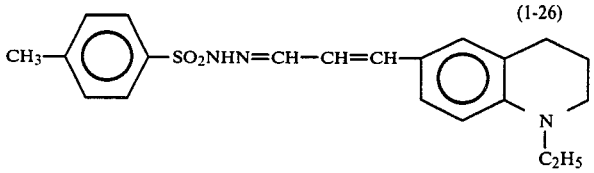

(1-27)

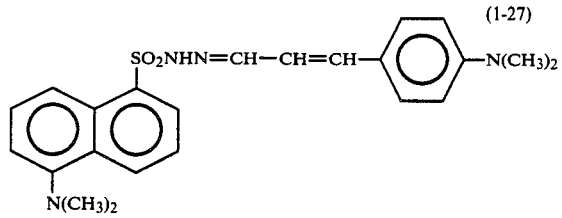

(1-28)

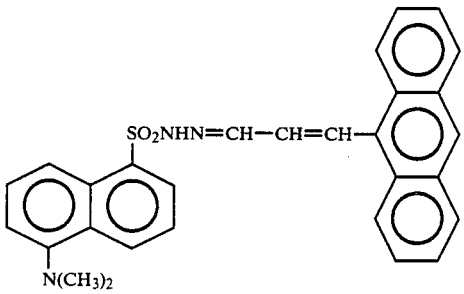

(1-29)

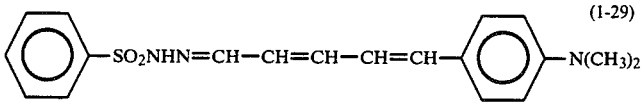

(1-30)

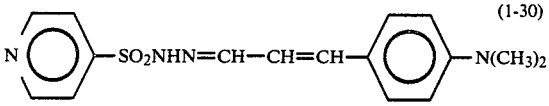

(1-31)

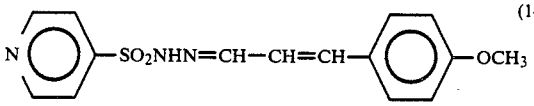

(1-32)

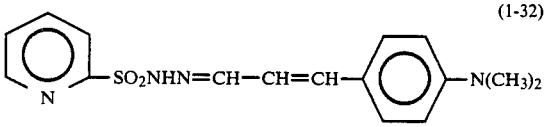

(1-33)

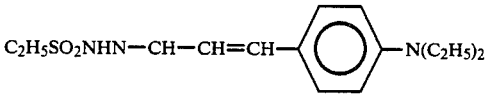

Furthermore, the sulfonylhydrazone compound may have at least two sulfonylhydrazone groups, and as compounds having the following formulas:

(1-34)

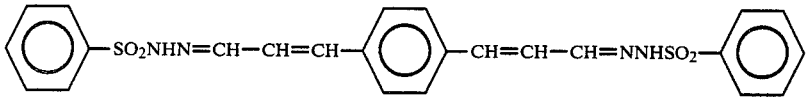

(1-35)

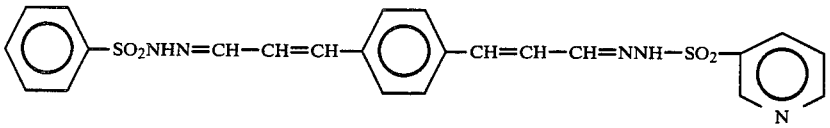

Of course, the compounds that can be used are not limited to those exemplified above. These sulfonylhydrazone compounds may be used alone or in mixtures of two or more.

The compounds may be prepared according to known methods. More specifically, the compounds can be obtained by condensing equimolar amounts of a sulfonylhydrazine compound with an a, $\beta$-unsaturated aldehyde compound in an organic solvent under heating, if necessary, in the presence of an acid such as acetic acid or hydrochloric acid.

Preparation of a typical sulfonylhydrazone compound is illustrated by the following example:

p-Dimetylaminocinnamaldehyde (1 g) is dissolved in 30 cc of methanol at 60° C. To the solution was added 1 cc of glacial acetic acid and benzenesulfonyl hydrazide (950 mg). The mixture was stirred for 1 hour and the resulting precipitates were filtered. Green crystals were formed in an amount of 1.53 g (84%).

Preferred examples of semicarbazone compounds ("compound (2)") are as follows:

(2-1)

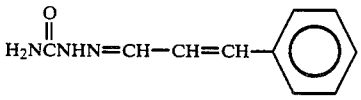

(2-2)

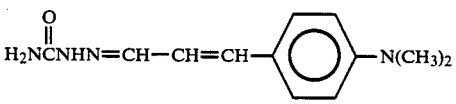

(2-3)

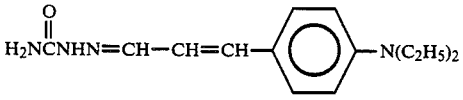

(2-4)

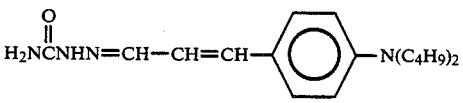

-continued
(2-5)
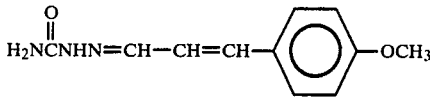
(2-6)
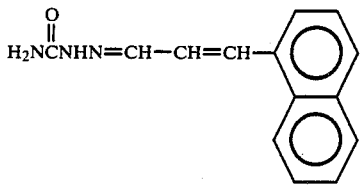
(2-7)
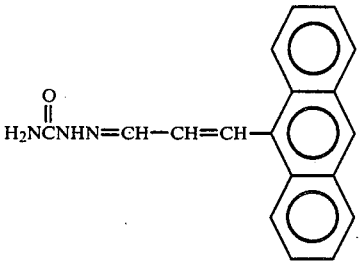
(2-8)
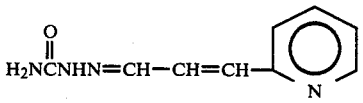
(2-9)
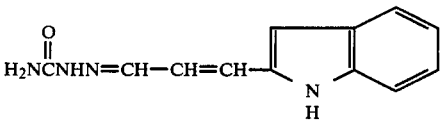
(2-10)
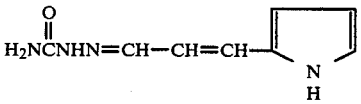
(2-11)
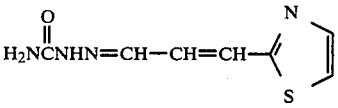
(2-12)
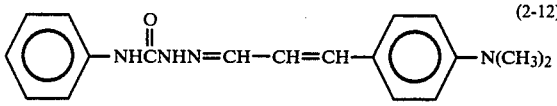
(2-13)
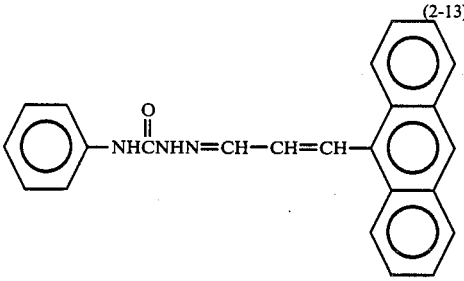
(2-14)
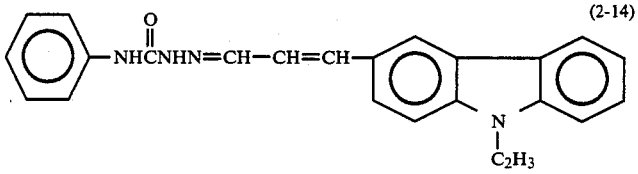
(2-15)
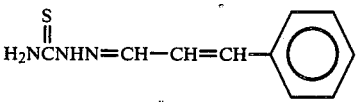
(2-16)
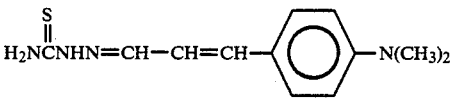
(2-17)
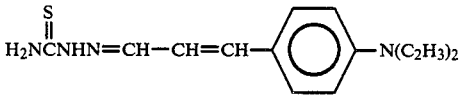
(2-18)
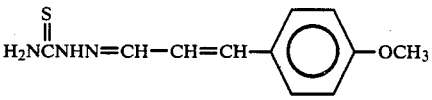
(2-19)
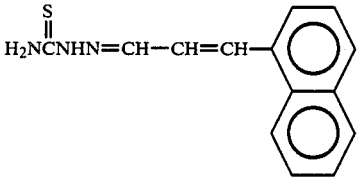
(2-20)
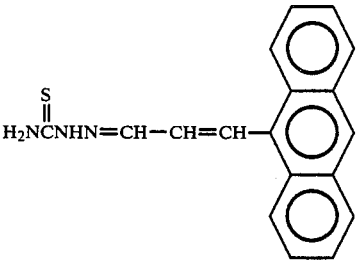

-continued
(2-21)
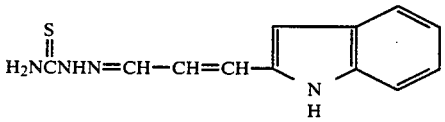
(2-22)
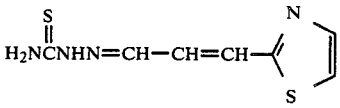
(2-23)
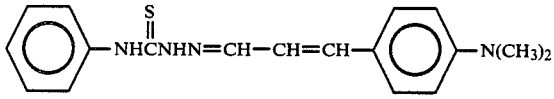
(2-24)
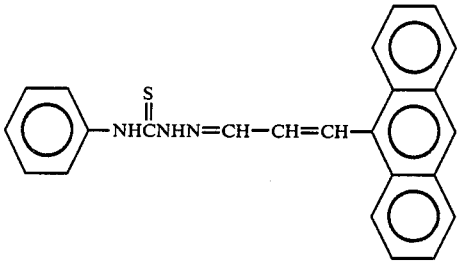
(2-25)
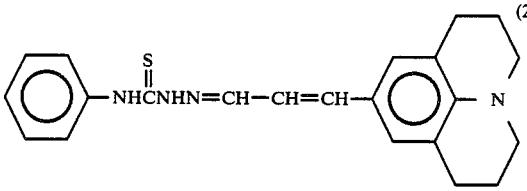
(2-26)
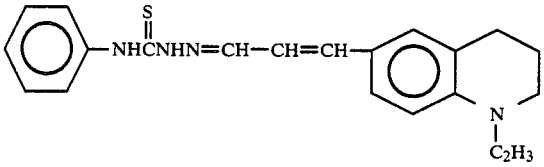
(2-27)
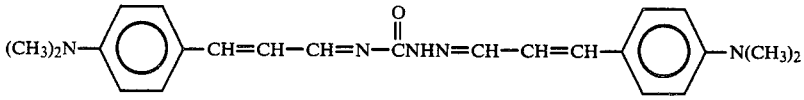
(2-28)
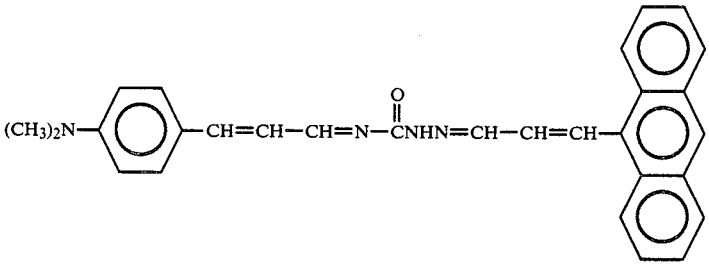
(2-29)
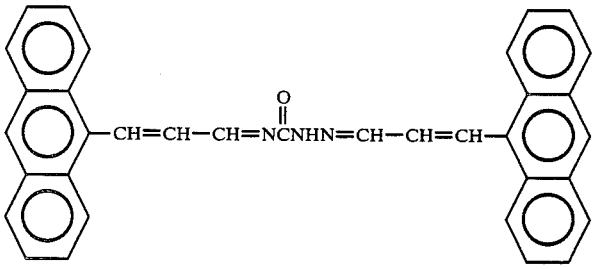
(2-30)
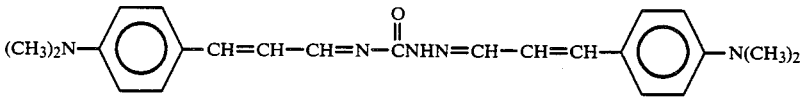
(2-31)
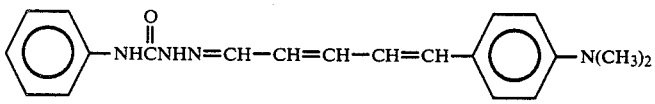

-continued

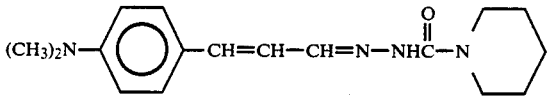

(2-32)

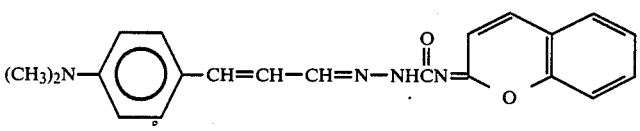

(2-33)

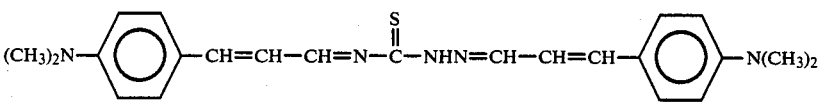

(2-34)

Furthermore,

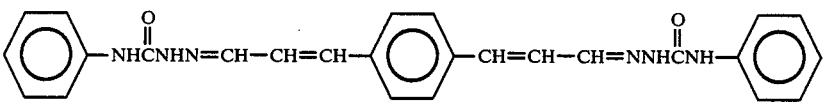

(2-35)

The semicarbazone compounds may be prepared by known methods, as for example:

p-Dimetylaminocinnamaldehyde (1 g) is dissolved in 30 cc of methanol at 60° C. To the solution was added 1 cc of glacial acetic acid and 4-phenylthiosemicarbazide (950 mg). And the mixture was stirred for 1 hour. Resulting precipitates were filtered. Orange crystals were formed in an amount of 1.40 g (76%).

Preferred examples of carbohydrazone compounds ("compound (3)") are as follows:

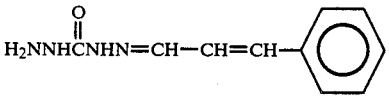

(3-1)

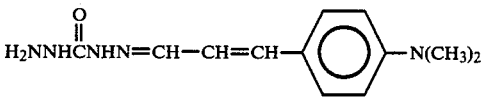

(3-2)

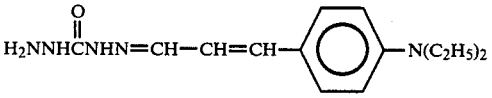

(3-3)

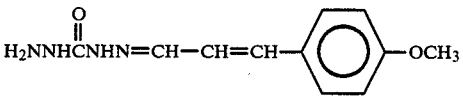

(3-4)

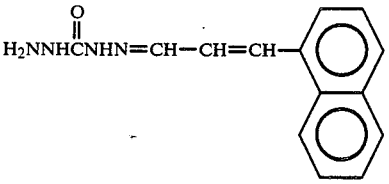

(3-5)

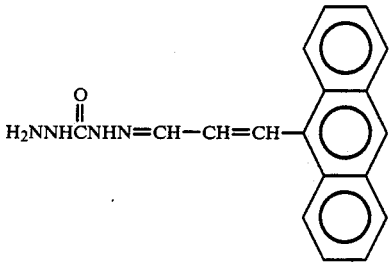

(3-6)

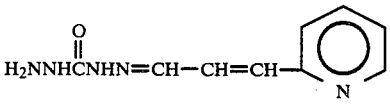

(3-7)

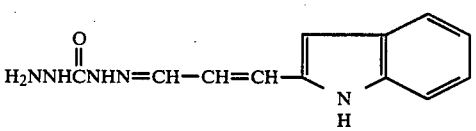

(3-8)

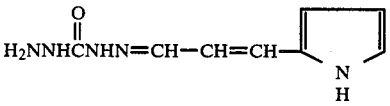

(3-9)

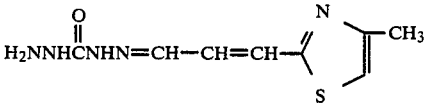

(3-10)

-continued
(3-11)
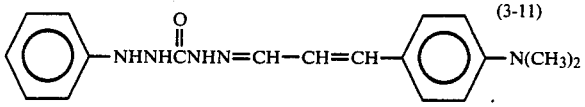
(3-12)
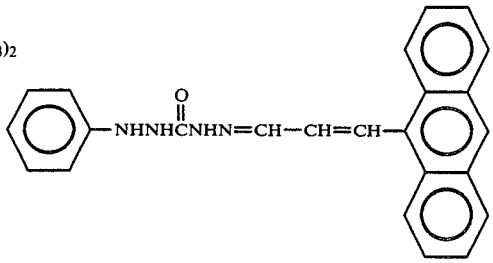
(3-13)
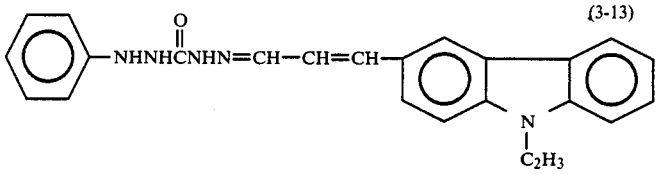
(3-14)
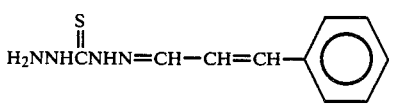
(3-15)
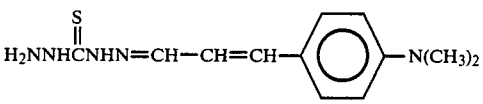
(3-16)
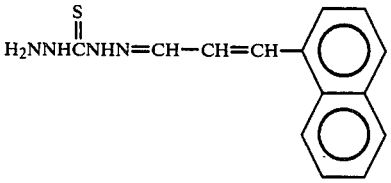
(3-17)
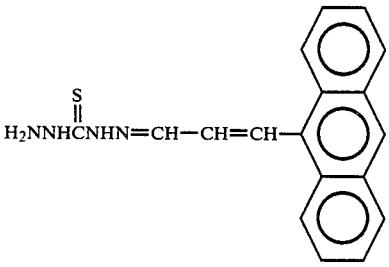
(3-18)
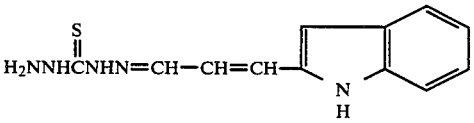
(3-19)
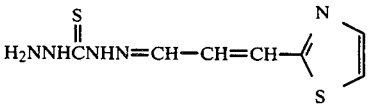
(3-20)
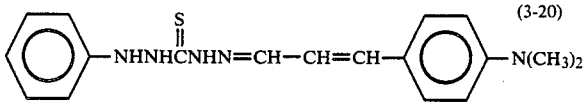
(3-21)
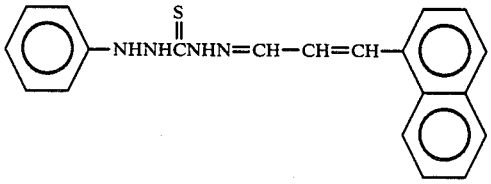
(3-22)
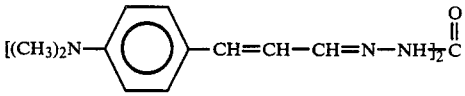
(3-23)
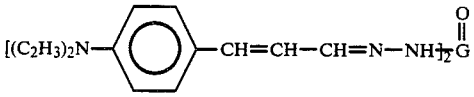
(3-24)
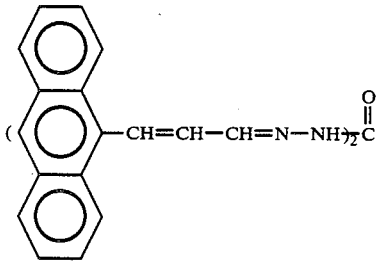
(3-25)
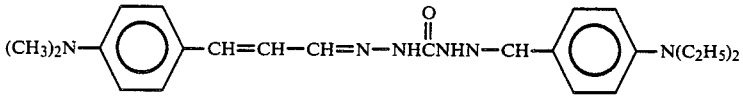

-continued
(3-26)
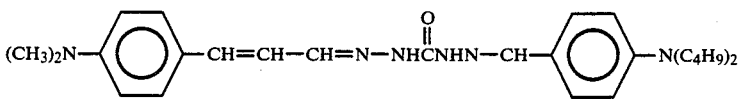
(3-27)
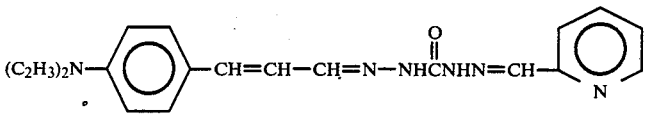
(3-28)
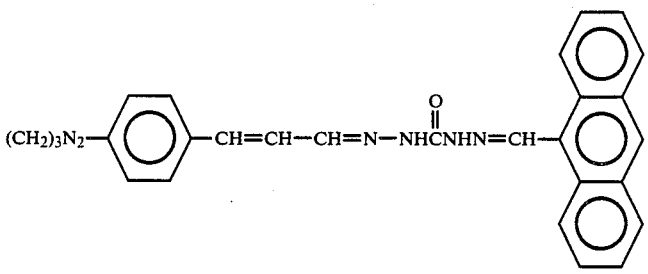
(3-29)
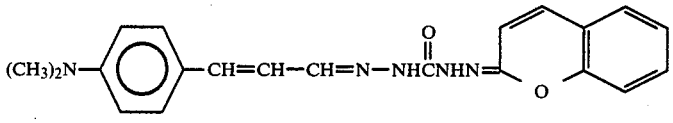
(3-30)
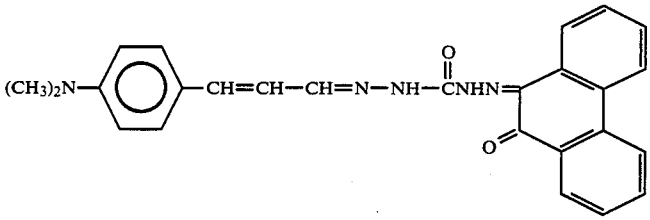
(3-31)
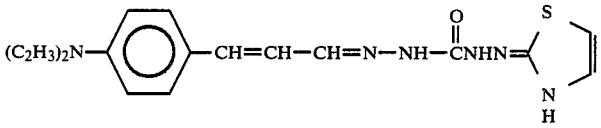
(3-32)
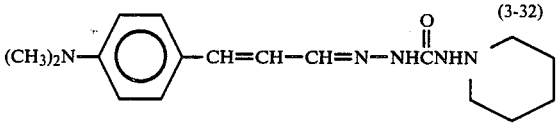
(3-33)
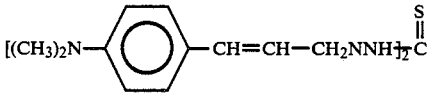
(3-34)
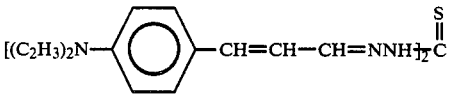
(3-35)
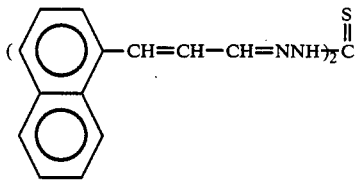
(3-36)
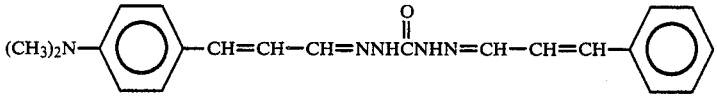
(3-37)
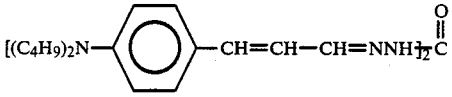

-continued

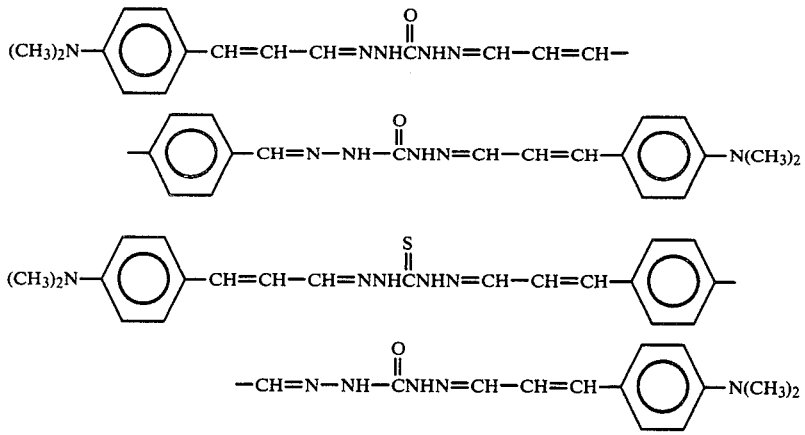

(3-38)

(3-39)

The carbohydrazone may be produced by any of a variety of known methods, such as:

Carbohydrzide (18 g) was suspended in a mixture of 500 cc of methanol and 50 cc of glacial acetic acid. To the suspension was added p-dimethylaminocinnamaldehyde suspended in 1000 cc of methanol, and the mixture was stirred for 3 hours and allowed to stand overnight. Resulting precipitate was filtered and washed with methanol twice. Yellowish green powder 75 g (85%).

The compounds (1) through (3) are advantageously used in the various fields as photoconductors which are rendered photoconductive irradiation with light.

These compounds (1) through (3) may be used alone or as mixtures of two or more.

Some of the organic photoconductors of the present invention represented by the formula (I) are insoluble or partially insoluble in ordinary solvents, and are insoluble even in the polymeric binder, and, therefore, remain in the form of a suspension.

In this case, an organic photoconductor having a small diameter is preferable from the viewpoint of good dispersion. In this respect, it is preferable that the particle diameter of the organic photoconductor be 1 μm or less, more preferably 0.1 μm or less.

Known polymeric binders may be used in the present invention. For example, polyamides, polyurethanes, polyesters, polyester-amides, polyethers, polycarbonates, polyamide-imides, homopolymers and copolymers of acrylic acid esters, homopolymers and copolymers of methacrylic acid esters, homopolymers and copolymers of styrene, homopolymers and copolymers of vinyl acetate, homopolymers and copolymers of vinyl chloride, polyvinyl acetals, homopolymers and copolymers of chlorinated olefins, alkyd resines, silicone resines, ketones, resines, xylene resines and epoxy resines can be mentioned. Of course, polymeric binders that can be used are not limited to those exemplified above. These polymeric binders may be used alone or in the form of blends or copolymers of two or more of them. Furthermore, these polymeric binders may be crosslinked with appropriate crosslinking agents.

The organic photoconductor used in the present invention is effective as a photoconductor and excellent organic photoconductor of the present invention is used for an electrophotographic photosensitive material, a photosensitive layer of the organic photoconductor and polymeric binder can be used as a photoconductive layer or charge transport layer in any known modes. As typical instances, there can be mentioned (a) an electroconductive substrate/photoconductive layer structure, (b) an electroconductive substrate/charge generating layer/charge transport layer structure and (c) an electroconductive substrate/charge transport layer/charge generating layer structure.

In the present invention, the term "photosensitive layer" is intended to include a photoconductive layer, a charge generating layer/charge transport layer, or a charge transport layer/charge penetrating layer in above-mentioned structures (a), (b) or (c).

In case of the structure (a), the photoconductive layer includes the following three types, that is, (i) a photoconductive layer comprising at least one photoconductor selected from the above-mentioned compounds (1) through (3), a polymeric binder and, if necessary, a sensitizing dye, (ii) a photoconductive layer comprising a charge generating material, at least one photoconductor selected from the above-mentioned compounds (1) through (3) and a polymeric binder, (iii) a photoconductive layer comprising at least one photoconductor selected from the above-mentioned compounds (1) through (3), a charge generating material, a sensitizing dye and a polymeric binder.

In case of the structure (b) or (c), the charge generating layer contains a charge generating material, and the charge transport layer comprises at least one photoconductor selected from the above-mentioned compounds (1) through (3) and a polymeric binder.

Each of the photoconductive layer, charge generating layer and charge transport layer may be a laminate of at least two layers differing in composition. Furthermore, in the above-mentioned structures (a), (b) and (c), an intermediate layer may be disposed between the electroconductive substrate and the photoconductive layer, charge generating layer or charge transport layer. More specifically, there may adopted (d) an electroconductive substrate/intermediate layer/photoconductive layer structure, (e) an electroconductive substrate/intermediate layer/charge generating layer/charge transport layer structure and (f) an electroconductive substrate/intermediate layer/charge transport layer/charge generating layer structure. By the term "intermediate layer" used herein are meant an adhesive layer and a barrier layer. It is preferable that the thickness of the intermediate layer be not thicker than 20μ, especially not thicker than 5μ.

In the present invention, the photoconductive layer or charge generating layer can be formed either directly on the electroconductive substrate or charge transport layer or on an intermediate layer formed thereon according to need by vacuum deposition of the photoconductive or charge generating material or by coating of a dispersion formed by dispersing the photoconductor or charge generating material in the form of fine particles in a dispersion medium by a ball mill, a homogenizing mixer or the like and, if necessary, incorporating a polymeric binder into the dispersion.

Furthermore, the photoconductive layer, charge generating layer, charge transport layer and intermediate layer may be formed according to any conventional coating method such as a film-applying method, a brush coating method, a dip coating method, a knife coating method, a roll coating method, a spray coating method, a flow coating method and a rotational coating method using a spinner or wheeler.

As the sensitizing dye, there can be mentioned triphenylmethane dyes such as Brilliant Green, Victoria Blue B, Methyl Violet, Crystal Violet and Acid Violet 6B; rhodamine dyes such as Rhodamine B, Rhodamine 6G, Rhodamine G Extra, Sulforhodamine B and Fast Acid Eosine G, xanthene dyes such as Eosine S, Eosine A, Erythrocin, Phloxine, Rose Bengale and Fluoresceine; thiazine dyes such as Methylene Blue, acridine dyes such as Acridine Yellow, Acridine Orange and Trypaflavin; quinoline dyes such as Pinacyanol and Cryptocyanine; quinone and ketone dyes such as Alizarine, Alizarine Red S and Quinizarin; cyanine dyes; chlorophyll; allylmethane dyes such as Violet Fuchsine, Erythrocin 2Na, Rhodamine B500, Fanal Pink B, Rhodamine 6GDN and Auramine; polymethine dyes such as 3,3'-diethylthiacarbocyanine iodide; azo dyes such as Eriochrome Blue Black R; azomethine dyes such as bis(p-dimethylaminobenzal)azine; carbonyl dyes such as Solway Ultra Blue B and Alizarine Cyanine Green GWA, heterocyclic compounds such as N,N'-pentamethylenebis(benzthiazole)perchlorate; and phthalocyanine dyes such as Segnale Light Turquoise, Sensitizing dyes that can be used are not limited to those exemplified above. The most preferable sensitizing dye is triphenylmethane compounds. This compound can preferably be more than 50 wt% of the sensitizing dye.

As the triphenylmethane compounds, Malachite Green, Brilliant Green, Guinea Green B, Brilliant Milling Green B, Para Magenta, Methyl Violet, Ethyl Violet, Crystal Violet, Formyl Violet S4B, Eriochrom Azurol B, Eriochrom Cyanine R, Victoria Blue B, Naphthalene Green V, Wool Green S, Victoria Pure Blue B, Brilliant Indo Cyanine, Bromcresol Green and Bromphenol Blue can be used effectively. Triphenylmethane compounds that can be used are not limited to those exemplified above. These triphenylmethane compounds may be used alone or in the form of mixtures of two or more of them.

Conventional charge generating materials can be used in the present invention. For example, inorganic photoconductors such as selenium, selenium alloys and cadmium sulfide, and organic photoconductors such as phthalocyanine pigments, perylene pigments, anthraquinone pigments, azo pigments, bisazo pigments, cyanine pigments, indigo pigments, quinacridone pigments and perinone pigments can be mentioned. These charge generating materials may be used alone or in the form of mixtures of two or more of them.

The most preferable charge generating materials are phthalocyanine pigments, bisazo pigments and indigo pigments. These pigments can preferably be more than 50 wt% of the charge generating material.

As preferred examples of phthalocyanine compounds metalfree phthalocyanine or metal phthalocyanine represented by the following general formulas (II) or (III) can be mentioned.

(II)

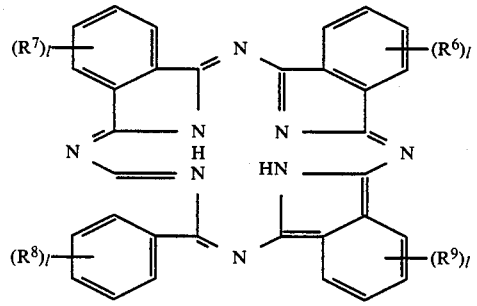

(III)

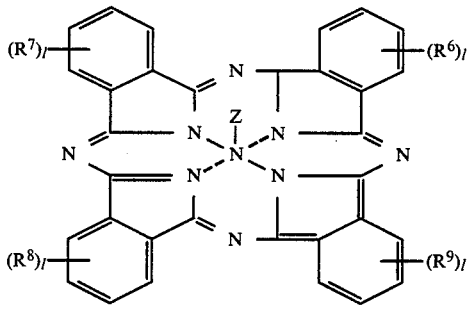

wherein $R^6$, $R^7$, $R^8$ and $R^9$ are hydrogen atoms or halogen atoms, and wherein l is 0, 1, 2, 3 or 4, M is Al, Ga, Si, Sn, Ge, V, Cn, Co, Mg, Ni, Pb, Pt or In, Z is Cl, F or O.

These compounds may be used alone or in the form of mixtures of two or more.

The phthalocyanine pigments can be used with conventional electron acceptor compounds and/or sensitizing additives for improving sensitivity and the durability.

As the electron acceptor, the following compounds may be mentioned. Phthalic anhydride, tetrachlorophthalic anhydride, 1,3,5-tricyanobenzene, picryl chloride, 1-chloro-2,4-dinitrobenzene, 1-bromo-2,4-dinitrobenzene, 4-nitrobiphenyl, 4,4'-dinitrobiphenyl, 2,4,6-trinitroanizole, trichlorotrinitrobenzene, 1,5-dichloro-2,4-dinitrobenzene, 1,5-dibromo-2,4-dinitrobenzene, p-dinitrobenzene, chloranil, bromanil, 2,4,7-trinitro-9-fluorenone, 2,4,5,7-tetranitro-9-fluoranone, trinitroanthracene, dinitroacridine, tetracyanopyrene and dinitroanthraquinone.

As the sensitizing additives, there can be used metalfree or metal phthalocyanine derivatives having one or more substituents, such as amino, nitro, alkoxy, cyano, carboxy, mercapto and alkylthio groups. Furthermore there can also be used metal-free or metal phthalocyanine derivatives having one or more functional groups connected to the phthalocyanine ring by divalent groups such as methylene, carbonyl, sulfonyl or imino groups.

As preferred examples of the sensitizing additives, the following compounds can be mentioned:

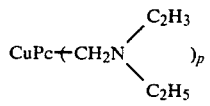

(4-1)

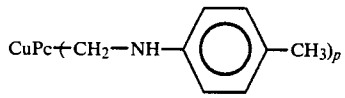

(4-2)

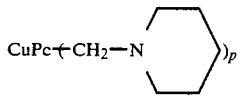

(4-3)

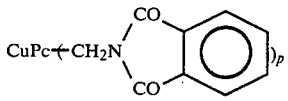

(4-4)

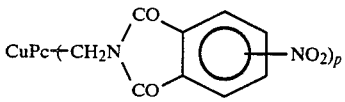

(4-5)

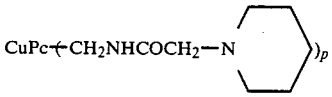

(4-6)

$CuPc\leftarrow CH_2NHCOCH_2-N\rangle_p$ $CuPc\leftarrow CH_2COOC_9H_{19})_p$ (4-7)

$CuPc\leftarrow COCH_2NHC_8H_{17})_p$ (4-8)

(4-9)

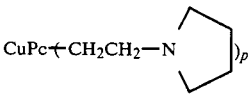

wherein CuPc represents copper phthalocyanine residue and P is an integer of from 1 to 4.

In the present invention, it is preferable that the weight ratios among the phthalocyanine pigments/electron acceptor compound/sensitizing additives be 1/(0–0.5)/(0–0.5).

Preferable examples of bisazo compounds in accordance with this invention are as follows:

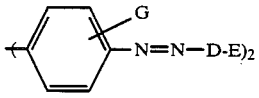

(IV)

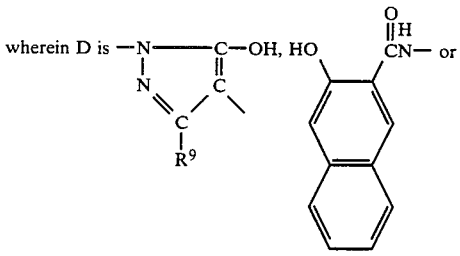

-continued

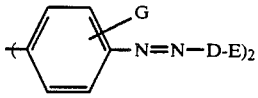

(IV)

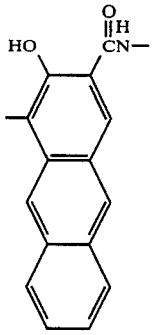

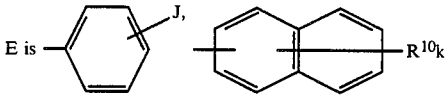

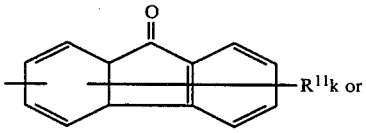

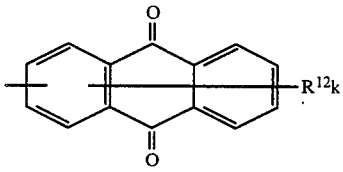

G.J. can independently signify a hydrogen atom, a methyl group, a methoxy group, a carboxy group, a hydroxy group, a chlorine atom or a bromine atom, $R^9$, $R^{10}$, $R^{11}$, $R^{12}$ independently signify a hydrogen atom, an unsubstituted or a substituted alkyl group containing 1 to 15 carbon atoms, an unsubstituted or a substituted aryl group containing 6 to 15 carbon atoms, an unsubstituted or a substituted aralkyl group containing 7 to 15 carbon atoms, an unsubstituted or a substituted amino group, a nitro group, a halogen atom, a hydroxy group, an alkoxy group or an acyl group and k is 0, 1 or 2, in the case where k is 2, each one of $R^9$, $R^{10}$, $R^{11}$ and $R^{12}$ can signify two different substituents.

As preferred examples of bisazo dyes represented by the general Formula (IV), the following compounds can be mentioned:

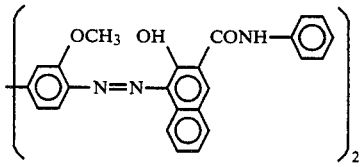

(5-1)

-continued
(5-2)
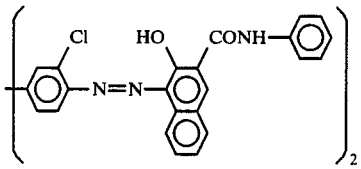
(5-3)
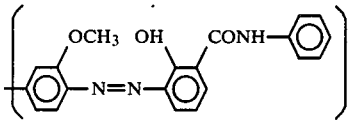
(5-4)
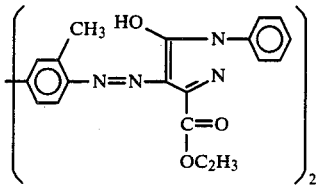
(5-5)
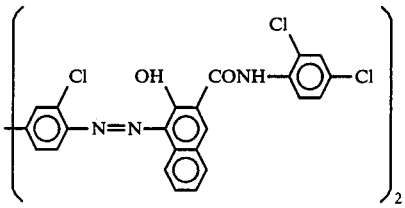
(5-6)
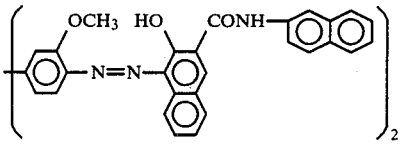
(5-7)
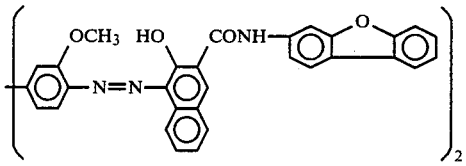
(5-8)
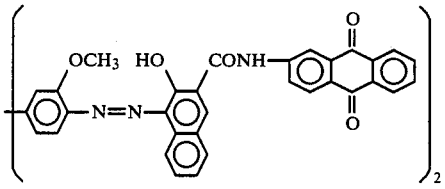
(5-9)
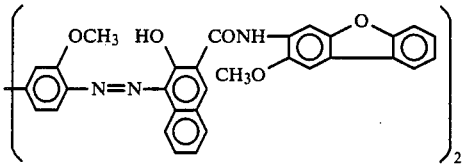
-continued
(5-10)
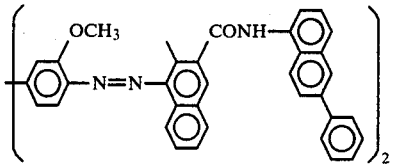
(5-11)
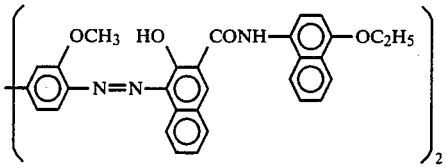
(5-12)
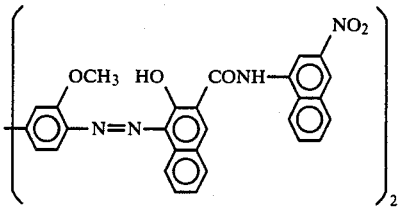
(5-13)
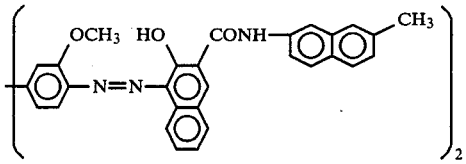
(5-14)
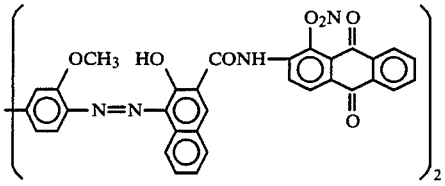
(5-15)
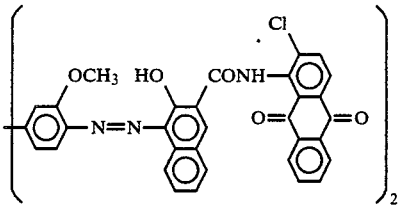
(5-16)
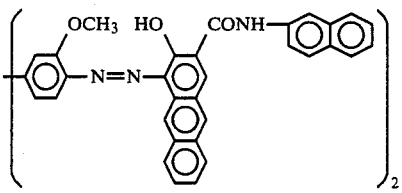

-continued
(5-17)
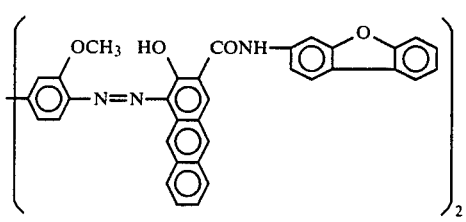
(5-18)
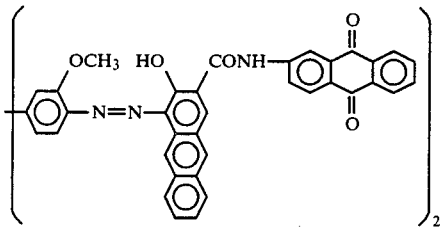
(5-19)
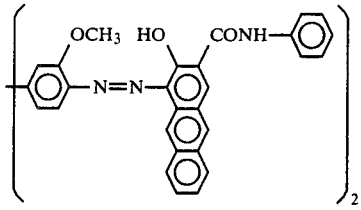
(5-20)
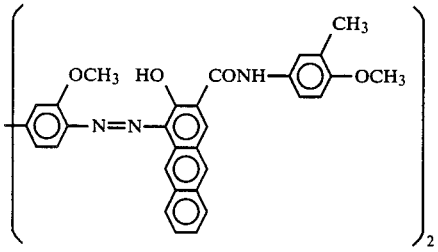
(5-21)
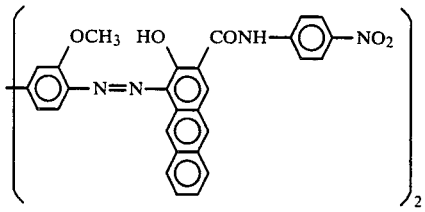
(5-22)
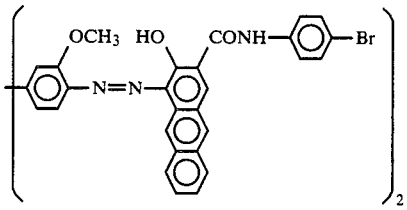
Preferred examples of indigo pigments are as follows:
(6-1)
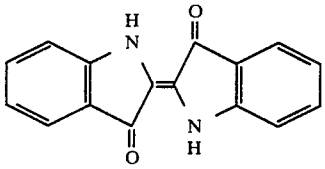
(6-2)
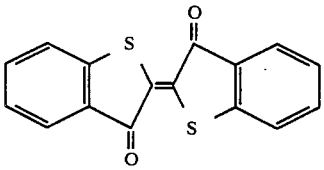
(6-3)
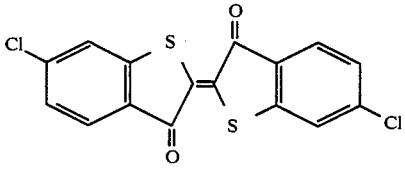
(6-4)
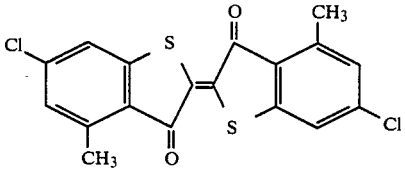
(6-5)
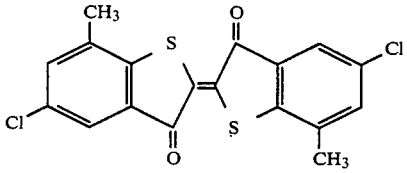
(6-6)
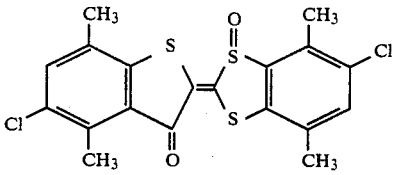
(6-7)
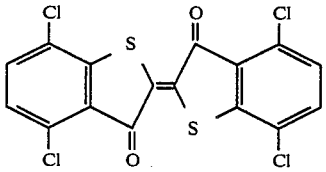
(6-8)
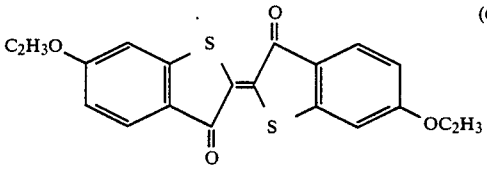
(6-9)
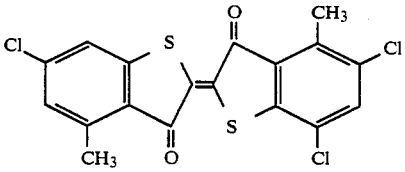

-continued (6-10)

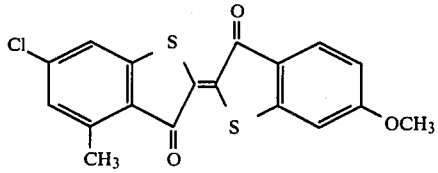

(6-11)

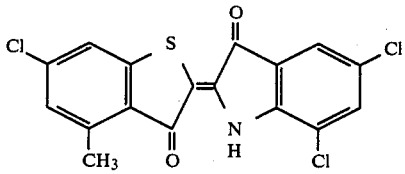

(6-12)

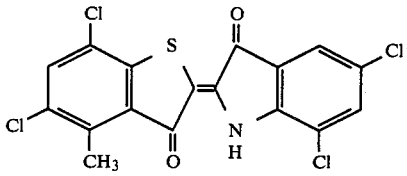

(6-13)

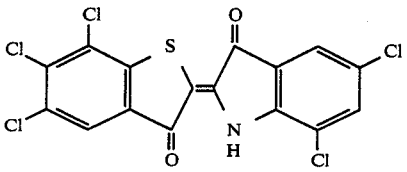

(6-14)

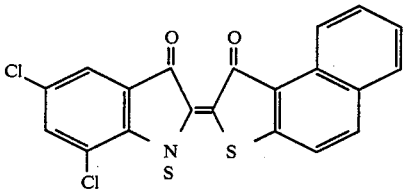

(6-15)

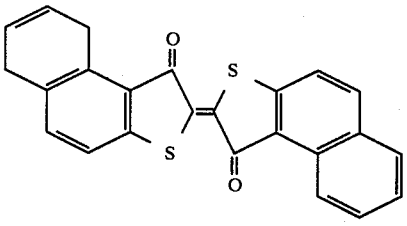

(6-16)

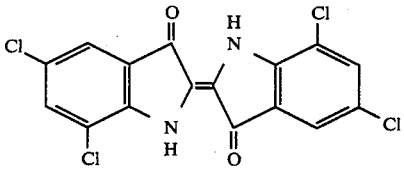

(6-17)

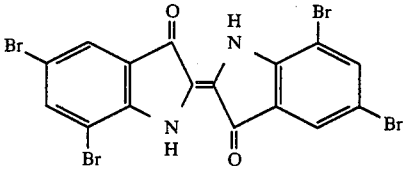

In the present invention, most of phthalocyanine compounds bisazo dyes and indigo dyes that can be used are insoluble in ordinary organic solvents. So these dyes must also be used in the form of particles with small diameter in order to achieve good dispersion in binders. It is preferred that the particle diameter is less than 1 micrometer and it is more preferable that the particle diameter is less than 0.1 micrometer.

In case of positive charging it is preferable that the photoconductive layer in the structure (a) contains an organic photoconductor represented by the Formula (I), and at least one compound selected from the group consisting of phthalocyanine pigments, bisazo pigments, indigo pigments and the triphenylmethane compounds, and a polymeric binder.

In case of the structure (b) or (c), the charge transport layer comprises an organic photoconductor and a polymeric binder, and the charge generating layer comprises a polymeric binder and at least one compound selected from the group consisting of phthalocyanine pigments, bisazo pigments, indigo pigments and triphenylmethane compounds.

In the present invention, if necessary, a protective layer may be formed on the surface of the electrophotographic photosensitive material (in the case of structure (b) for example, there can be mentioned an electroconductive substrate/charge generating layer/charge transport layer/protective layer structure), or an antistatic layer may be formed on the back surface (in case of the structure (b), there can be mentioned an antistatic layer/electroconductive substrate/charge generating layer/charge transport layer structure).

In the present invention, a transparent electrophotographic photosensitive material comprising a transparent photosensitive layer formed on a transparent electroconductive substrate may be used as a slide film, a micro-film or an OHP film. When this transparent electrophotographic photosensitive material is applied to the electrophotographic process in which light exposure is effected from the side of the transparent electroconductive substrate, a white dielectric layer may be formed on the photosensitive layer, if necessary. In case of this electrophotographic photosensitive material, if a toner image formed, for example, on the white dielectric layer is directly fixed, a clear image is formed and an especially clear image is obtained in case of color reproduction. Accordingly, the electrophotographic photosensitive material of this type is valuable for this purpose.

Various additives may be incorporated into the photoconductive layer, charge generating layer and charge transport layer in the present invention. For example, when these layers are formed by coating a plasticizer may be used for improving flowability in the coating step or the smoothness of the resulting coating. Moreover, such additives as an adhesion promoter, a stabilizer, an antioxidant, an ultraviolet absorber and a lubricant may be incorporated. Furthermore, known organic photoconductors, charge generating materials and charge transport materials may be incorporated according to need, as long as the characteristics of the electrophotographic photosensitive material of the present invention are not degraded.

In the above-mentioned structure (a), it is preferable that the thickness of the photoconductive layer be 2 to 50μ. In the above-mentioned structure (b) or (c), it is preferable that the thickness of the charge generating layer be 0.01 to 5μ and the thickness of the charge transport layer be 3 to 30μ. The kind of the electroconductive substrate is not particularly critical. For example, papers and plastic films which are rendered electroconductive by application of an electroconductive compound or a metal foil layer, and metal sheets may be used as the electroconductive substrate.

Since the so-obtained electrophotographic photosensitive material comprises a photoconductive layer or charge transport layer containing at least one organic photoconductor selected from the above mentioned compounds (1) through (3) and a polymeric binder, which is formed on an electroconductive substrate, the electrophotographic photosensitive material is excellent in charge acceptance and a charge retentivity and has a high sensitivity as well as a good durability.

Although the starting compounds of known hydrazone and pyrazoline derivatives are, for example, phenylhydrazine and diphenylhydrazine, which are carcinogenic substances, the starting compounds of the organic photoconductors used in the present invention are sulfonyl hydrazide, thiosemicarbazide and carbohydrazide which are quite safe. Furthermore, since the organic photoconductors used in the present invention have good compatibility with conventional polymeric binders, the range of selection of polymeric binders is very broad.

Accordingly, at the developing step, not only a two-component type toner but also a one-component type toner can be applied to an electrophotographic photosensitive material having a photosensitive layer containing the organic photoconductor of the present invention and a polymeric binder. Therefore the range for the selection of toners is also broadened. Moreover, since the organic photoconductor used in the present invention is excellent as the charge transport material, the range for the selection of charge generating materials to be combined with the organic photoconductor is also broadened.

Some electrophotographic photosensitive materials of the present invention having the above-mentioned structure (b), that is, the electroconductive substrate/charge generating layer/charge transport layer structure, are effective for the positive charging as well as for the negative charging. The amount of ozone generated at the positive charging by the corona discharge is ordinarily smaller than at the negative charging by the corona discharge, and the contamination of the environment is reduced at the positive charging. Therefore, the positive charging is ordinarily preferable. A few of organic photoconductors are effective for the positive charging, and in many cases, the negative charging is inevitably adopted. In view of the foregoing, it is significant that the electrophotographic photosensitive material of the present invention having the above-mentioned structure (b) is effective for the positive charging.

In the present invention, the electrophotographic properties are determined according to the following procedures. By using an electrostatic paper analyzer (Model EPA-SP-428 supplied by Kawaguch Electric Work Co., Ltd.), a voltage of 6 KV is applied for 6 seconds, and the acceptance potential is measured. Then the dark decay is performed for 5 seconds and the dark decay quantity is measured. Then, the light exposure is carried out at 300/7 luxes for 15 seconds by using a tungsten light having a color temperature of 2854° K. as the light source and the exposure for half decay was measured. The acceptance potential thus determined indicates the static charge acceptance in the dark, the dark decay quantity indicates the charge retentivity in the dark, and the exposure for half decay indicates the sensitivity. In case of positive charging, the photosensitive material was charged at +6 KV for 6 seconds. In case of positive charging, compounds (3) are preferable. Among them, the compounds (3) represented by the Formula (g), especially symmetrical carbohydrazone compounds, are more preferable.

And among the phthalocyanine pigments, bisazo pigments, indigo pigments and triphenylmethane compounds, the phthalocyanine pigments or the bisazo pigments are preferable for positive charging.

In the present invention, it is preferable that the weight ratio of organic photoconductor/polymeric binder/sensitizing dye/charge generating material/additive be 1/(0.5 to 30)/(0 to 0.2)/(0 to 1)/(0 to 1).

In structure (a), it is preferable that the weight ratios among the organic photoconductor/a compound selected from the group consisting of phthalocyanine pigments, bisazo pigments, indigo pigments and triphenylmethane compound/polymeric binder/ other additives be 1/0.0001-1.2/-30/0-1.

In structure (b) or (c), it is preferable that the charge transport layer comprises at least one compound represented by the formula (I), a polymeric binder and other additives at weight ratios of 1/0.5-30/0-1.

It is preferable that the charge generating layer comprises at least one compound selected from the group consisting of phthalocyanine pigments, bisazo pigments, indigo pigments and triphenylmethane compounds plus charge generating materials/polymeric binder/other additives, at weight ratios of 1/0.2-5/0-2, wherein the other additives include electron acceptor compounds, sensitizing additives and various additives which may be used in the coating process.

The present invention will now be described in detail with reference to the following examples that by no means limit the scope of the invention.

EXAMPLE 1

The compounds (1-1) (2-12) and (3-22) were prepared. These compounds were independently mixed with a polyester resin (Toyobo "Vylon" 200) and tetrahydrofuran to form photosensitive solutions (1), (2) and (3), respectively. In each run, the photoconductive compound/polyester resin/tetrahydrofuran weight ratio was 10/10/150.

Separately, three electroconductive films were prepared by vacuum-depositing aluminum in a thickness of 0.1μ on one surface of biaxially drawn polyethylene terephthalate films having a thickness of 100μ (Lumirror: supplied by Toray Industries, Inc.).

The above solutions (1) through (3) were independently coated on the Al-deposited surfaces of these electroconductive films so that the thickness of the coating after drying was 12μ, whereby electrographic photosensitive materials (11), (12) and (13) were obtained, respectively.

With respect to each of the so-obtained electrophotographic photosensitive materials, the acceptance potential and the exposure for half decay were determined. The obtained results are shown in Table 1, from which it is seen that each of the foregoing compounds is a good organic photoconductor.

TABLE 1

| Photosensitive Material No. | Acceptance potential (V) | (NEGATIVE CHARGING) Exposure for half decay (lux.sec.) |
|---|---|---|
| (11) | 640 | 80 |
| (12) | 680 | 70 |

TABLE 1-continued

| Photosensitive Material No. | Acceptance potential (V) | (NEGATIVE CHARGING) Exposure for half decay (lux.sec.) |
|---|---|---|
| (13) | 790 | 20 |

The photosensitive material (13) charged positively had an acceptance potential of 850 V and an exposure for half decay of 18 lux.sec.

EXAMPLE 2

A dispersion obtained by pulverizing in a ball mill a mixture comprising metal-free phthalocyanine, a polyester resin (Toyobo "Vylon" 200) and tetrahydrofuran at a weight ratio of 30/10/960 was coated in a thickness of 0.5μ (after drying) on the Al-deposited surface of each of three electroconductive films obtained in the same manner as described in Example 1 to form a charge generating layer.

The photosensitive solutions (1) through (3) prepared in Example 1 were independently coated in a thickness of 10μ (after drying) on the so-formed charge generating layers to form electrophotographic photosensitive materials (21) through (23) having a charge transport layer, respectively.

With respect to each of the so-obtained three photosensitive materials, the acceptance potential, the dark decay quantity and the exposure for half decay were determined. The results are shown in Table 2, from which it is seen that each of the electrophotographic photosensitive materials of the present invention has a high acceptance potential, a good charge retentivity and a high sensitivity. It also is seen that the photosensitive materials of this example are especially excellent as the charge transport material as compared with the photosensitive materials of Example 1.

TABLE 2

| Photosensitive Material No. | Acceptance potential (V) | Dark Decay quantity (V) | (NEGATIVE CHARGING) Exposure for half decay lux.sec. |
|---|---|---|---|
| (21) | 620 | 120 | 12 |
| (22) | 670 | 110 | 12 |
| (23) | 700 | 130 | 8 |

The photosensitive material (23) charged positively had an acceptance potential of 690 V and an exposure for half decay of 8 lux.sec.

EXAMPLE 3

Three electrophotographic photosensitive materials (31), (32) and (33) were prepared by using Dian Blue (CI Pigment Blue 25, CI 21180) instead of the metal-free phthalocyanine used in Example 2.

With respect to each of the so-obtained three photosensitive materials, the acceptance potential, the dark decay quantity and the exposure for half decay were determined.

The results are shown in Table 3, from which it is seen that each of the electrophotographic photosensitive materials of the present invention has a high acceptance potential, a good charge retentivity and a high sensitivity. It also is seen that the photosensitive materials of this example are especially excellent as the charge transport material as compared with the photosensitive materials of Example 1.

TABLE 3

| Photosensitive Material No. | Acceptance Potential (V) | Dark Decay quantity (V) | (NEGATIVE CHARGING) Exposure for half decay (lux.sec.) |
|---|---|---|---|
| (31) | 590 | 100 | 13 |
| (32) | 690 | 110 | 12 |
| (33) | 740 | 120 | 8 |

The photosensitive material (33) charged positively had an acceptance potential of 730 V and an exposure for half decay of 10 lux.sec.

Thus, it was confirmed that the photosensitive materials (13), (23) and (33) can be effectively used also for a photographic process in which positive charging is effected.

COMPARATIVE EXAMPLE 1

An electrophotographic photosensitive material was prepared in the same manner as described in Example 2 except that the following carbohydrazone compound was used instead of the compound of the present invention.

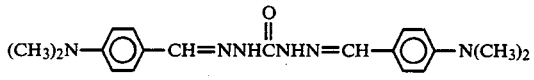

The results are shown in Table 4.

Thus, it is confirmed that the electrophotosensitive material (23) of the present invention is more effective in positive charging.

TABLE 4

| Photosensitive Material No. | Positive Charging | | Negative Charging | |
|---|---|---|---|---|
| | Acceptance potential (V) | Exposure for half decay (lux.sec.) | Acceptance potential (V) | Exposure for half decay (lux.sec.) |
| Comparative Example 1 | 680 | 150 | 660 | 15 |

EXAMPLE 4

The compounds (3-22) and (2-12) were prepared (the particle diameter of (3-22) was less than 0.1 μm).

These compounds were independently mixed with ε-Cu phthalocyanine, polyester resin and tetrahydrofuran in a ball mill for 3 hours. The weight ratio among the compound, ε-Cu phthalocyanine, polyester resin and tetrahydrofuran was 10/2/10/180. Thus two dispersions (1) and (2) were obtained.

Separately, two electroconductive films were prepared by vacuum-depositing aluminum in a thickness of 0.1μ on one surface of biaxially drawn polyethylene terephthalate films having a thickness of 100μ ("Lumirror" supplied by Toray Industries).

The above dispersions (1) and (2) were independently coated on the Al-deposited surfaces of these electroconductive films so that the thickness of the coating after drying was 12μ, whereby electrophotographic photosensitive materials (41) and (42) were obtained.

With respect to each of the so-obtained two electrophotographic photosensitive materials, the acceptance potential and the exposure for half decay were determined. The obtained results are shown in Table 5.

The compound (2-22) was prepared. An electrophotographic photosensitive material was prepared in the same manner as described in Example 1 except that ε-Cu phthalocyanine was not used.

The results are shown in Table 5.

Thus, it is confirmed that the electrophotographic material (1) of the present invention has excellent properties in positive charging.

TABLE 5

| | Photosensitive Material No. | Positive Charging Acceptance potential (V) | Positive Charging Dark Decay quantity (V) | Exposure for half (lux.sec.) | Negative Charging Acceptance potential (V) | Negative Charging Dark Decay quantity (V) | Negative Charging Exposure for half decay (lux.sec.) |
|---|---|---|---|---|---|---|---|
| Example 1 | (41) | 770 | 110 | 3 | 780 | 130 | 9 |
| | (42) | 680 | 120 | 15 | 720 | 140 | 18 |
| Example 4 | (13) | 850 | 120 | 18 | 790 | 110 | 20 |

EXAMPLE 5

Electrophotographic photosensitive materials (51)–(56) were obtained by forming a photosensitive layer shown in Table 6 on the electroconductive film obtained in Example 1.

It is seen that the photosensitive materials (51), (52), (53), (54), (55) and (56) have very excellent electrophotographic characteristics in positive charging.

TABLE 6

| Photosensitive Material No. | Composition of Photosensitive Layer (weight ratio) | Positive Charging Acceptance Potential (V) | Positive Charging Exposure for half decay lux 300 |
|---|---|---|---|
| (51) | (3-22)*1/β-Cu phthalocyanine/polyester resin = 100/60/100 | 725 | 8 |
| (52) | (3-22)*1/β-Cu phthalocyanine/(4—4)*2/polyester resin = 100/60/6/120 | 730 | 4 |
| (53) | (3-22)*1/β-metal-free phthalocyanine/polycarbonate resin = 100/40/100 | 700 | 10 |
| (54) | (3-22)*1/(5-1) *3/acryl resin = 100/20/150 | 750 | 7 |
| (55) | (3-22)*1/(6-17)*4/polyester resin = 100/30/100 | 770 | 12 |
| (56) | (3-22)*1/crystal violet/polycarbonate resin = 100/0.02/200 | 670 | 10 |

*1(3-22) is a compound represented by the Formula (3-22).
*2(4—4) is a sensitizing additive represented by the Formula (4—4).
*3(5-1) is a bisazo compound represented by the Formula (5-1).
*4(6-17) is an indigo compound represented by the Formula (6-17).

The following is claimed:

1. An electrophotograhic photosensitive material comprising a photosensitive layer formed on an electroconductive substrate, said photosensitive layer containing a polymeric binder and an organic photoconductor represented by the following Formula (I):

$$A\text{-}(CH{=}CH)_n CH{=}NNHY \qquad (I)$$

wherein A is selected from the group consisting of an alkyl group having 1 to 12 carbon atoms, an aralkyl group having 7 to 14 carbon atoms, an aryl group having 6 to 20 carbon atoms and a heterocyclic residue of a 3- to 30-membered ring, wherein n is 1 or 2, Y is selected from the group consisting of $-SO_2R'$, $$-\overset{\overset{\displaystyle X}{\|}}{C}NR^2R^3,\ -\overset{\overset{\displaystyle X}{\|}}{C}N{=}CR^2R^3$$

$$-\overset{\overset{\displaystyle X}{\|}}{C}N{=}CH{-}(CH{=}CH)_m B\ \ -\overset{\overset{\displaystyle X}{\|}}{C}NHNR^4R^5,$$

-continued $$-\overset{\overset{\displaystyle X}{\|}}{C}NHN{=}CR^4R^5,\ \text{or}\ -\overset{\overset{\displaystyle X}{\|}}{C}NHN{=}CH(CH{=}CH)_m B,$$

(wherein R′ is selected from the group consisting of an alkyl group having 1 to 12 carbon atoms, an aralkyl group having 7 to 14 carbon atoms, an aryl group having 6 to 20 carbon atoms and a heterocyclic residue of a 3- to 30-membered ring, and $R^2$ and $R^3$, $R^4$ and $R^5$, either form a ring together with the nitrogen atom to which $R^2$ and $R^3$, $R^4$ and $R^5$ are bonded and in this case $R^2$ and $R^3$, $R^4$ and $R^5$ independently signify (1) a carbon atom, or (2) at least one atom selected from the group consisting of an oxygen atom, a nitrogen atom, and a sulfur atom which is included in the same ring, or $R^2$ and $R^3$, $R^4$ and $R^5$ are not included in the same ring and in this case $R^2$ and $R^3$, $R^4$ and $R^5$ independently signify a hydrogen atom, an alkyl group having 1 to 12 carbon atoms, an aralkyl group having 7 to 14 carbon atoms, an aryl group having 6 to 20 carbon atoms or a heterocyclic residue of a 3- to 30-membered ring, B is selected from the group consisting of an alkyl group having 1 to 12 carbon atoms, an aralkyl group having 7 to 14 carbon atoms, an aryl group having 6 to 20 carbon atoms or a heterocyclic residue of a 3- to 30-membered ring, x is an oxygen atom or a sulfur atom, m is 1 or 2, and wherein $R^1$ through $R^5$, A and B may be either substituted or not substituted.

2. An electrophotographic photosensitive material as set forth in claim 1, wherein the organic photoconductor is a compound represented by the following general formula (a):

$$R'-\overset{\overset{\displaystyle O}{\|}}{\underset{\underset{\displaystyle O}{\|}}{S}}-NHN{=}CH(CH{=}CH)_n A \qquad (a)$$

wherein A and R′ independently signify an alkyl group having 1 to 12 carbon atoms, an aralkyl group having 7 to 14 carbon atoms, an aryl group having 6 to 20 carbon atoms or a heterocyclic residue of a 3- to 30-membered ring, and wherein n is 1 or 2.

3. An electrophotographic photosensitive material as set forth in claim 1, wherein the organic photoconductor is a compound represented by the following general Formulas (b), (c) or (d):

$$A\text{-}(CH{=}CH)_n CH{=}NNH{-}\overset{\overset{X}{\|}}{C}NR^2R^3 \quad (b)$$

$$A\text{-}(CH{=}CH)_n CH{=}NNH{-}\overset{\overset{X}{\|}}{C}N{=}CR^2R^3 \quad (c)$$

$$A\text{-}(CH{=}CH)_n CH{=}NNH{-}\overset{\overset{X}{\|}}{C}N{=}N\text{-}(CH{=}CH)_m B \quad (d)$$

wherein A and B independently signify an alkyl group having 1 to 12 carbon atoms, an aralkyl group having 7 to 14 carbon atoms, an aryl group having 6 to 20 carbon atoms or a heterocyclic residue of a 3- to 30-membered ring, $R^2$ and $R^3$ either form a ring together with the nitrogen atom to which $R^2$ and $R^3$ are bonded and in this case $R^2$ and $R^3$ independently signify (1) a carbon atom, or (2) at least one atom selected from the group consisting of an oxygen atom, a nitrogen atom, and a sulfur atom which is included in the same ring, or $R^2$ and $R^3$ are not included in the same ring and in this case $R^2$ and $R^3$ independently signify a hydrogen atom, an alkyl group having 1 to 12 carbon atoms, an aralkyl group having 7 to 14 carbon atoms, an aryl group having 6 to 20 carbon atoms or a heterocyclic residue of a 3- to 30-membered ring, x is an oxygen atom or a sulfur atom, n is 1 or 2, and m is 1 or 2.

4. An electrophotographic photosensitive material as set forth in claim 1, wherein the organic photoconductor is a compound represented by the following general Formulas (e), (f) or (g):

$$A\text{-}(CH{=}CH)_n CH{=}NNH\overset{\overset{X}{\|}}{C}{-}NH{-}NR^4R^5 \quad (e)$$

$$A\text{-}(CH{=}CH)_n CH{=}NNH\overset{\overset{X}{\|}}{C}{-}NHN{=}CR^4R^5 \quad (f)$$

$$A\text{-}(CH{=}CH)_n CH{=}NNH\overset{\overset{X}{\|}}{C}NHN{=}CH{-}(CH{=}CH)_m B \quad (g)$$

wherein A and B independently signify an alkyl group having 1 to 12 carbon atoms, an aralkyl group having 7 to 14 carbon atoms, an aryl group having 6 to 20 carbon atoms or a heterocyclic residue of a 3- to 30-membered ring, $R^4$ and $R^5$ either form a ring together with the nitrogen atom to which $R^4$ and $R^5$ are bonded and in this case $R^4$ and $R^5$ independently signify (1) a carbon atom, or (2) at least one atom selected from the group consisting of an oxygen atom, a nitrogen atom, and a sulfur atom which is included in the same ring, or $R^4$ and $R^5$ are not included in the same ring and in this case $R^4$ and $R^5$ independently signify a hydrogen atom, an alkyl group having 1 to 12 carbon atoms, an aralkyl group having 7 to 14 carbon atoms, an aryl group having 6 to 20 carbon atoms or a heterocyclic residue of a 3- to 30-membered ring, x is an oxygen atom or a sulfur atom, n is 1 or 2 and m is 1 or 2.

5. An electrophotographic photosensitive material comprising a photosensitive layer formed on an electroconductive substrate, said photosensitive layer containing a polymeric binder, an organic photoconductor as defined in claim 1, and a charge generating material consisting of at least one compound selected from the group consisting of phthalocyanine pigments, bisazo pigments, indigo pigments and triphenylmethane compounds, represented by the following general Formula (I):

$$A\text{-}(CH{=}CH)_n CH{=}NNHY \quad (I)$$

wherein A is selected from the group consisting of an alkyl group having 1 to 12 carbon atoms, an aralkyl group having 7 to 14 carbon atoms, an aryl group having 6 to 20 carbon atoms and a heterocyclic residue of a 3- to 30- membered ring, n is 1 or 2, Y is $-SO_2R'$, $$-\overset{\overset{X}{\|}}{C}NR^2R^3,\ -\overset{\overset{X}{\|}}{C}N{=}CR^2R^3$$

$$-\overset{\overset{X}{\|}}{C}N{=}C(CH{=}CH)_m B\ \ -\overset{\overset{X}{\|}}{C}NHNR^4R^5,$$

in the same ring and in this case $R^2$ and $R^3$, $R^4$ and $R^5$ independently signify a hydrogen atom, an alkyl group having 1 to 12 carbon atoms, an aralkyl group having 7 to 14 carbon atoms, an aryl group having 6 to 20 carbon atoms or a heterocyclic residue of a 3- to 30-membered ring, B is selected from the group consisting of an alkyl group having 1 to 12 carbon atoms, an aralkyl group having 7 to 14 carbon atoms, an aryl group having 6 to 20 carbon atoms and a heterocyclic residue of a 3- to 30-membered ring, x is an oxygen atom or a sulfur atom, $$-\overset{\overset{x}{\|}}{C}NHN{=}CR^4R^5,\ \text{or}\ -\overset{\overset{x}{\|}}{C}NHN{=}CH(CH{=}CH)_m{-}B$$

wherein R′ is an alkyl group having 1 to 12 carbon atoms, an aralkyl group having 7 to 14 carbon atoms, an aryl group having 6 to 20 carbon atoms and a heterocyclic residue of a 3- to 30-membered ring, and $R^2$ and $R^3$, $R^4$ and $R^5$, either form a ring together with the nitrogen atom to which $R^2$ and $R^3$, $R^4$ and $R^5$ are bonded and in this case $R^2$ and $R^3$, $R^4$ and $R^5$ independently signify (1) a carbon atom, or (2) at least one atom selected from the group consisting of an oxygen atom, a nitrogen atom, and a sulfur atom which is included in the same ring and in this case $R^2$ and $R^3$, $R^4$ and $R^5$ independently signify a hydrogen atom, an alkyl group having 1 to 12 carbon atoms, an aralkyl group having 7 to 14 carbon atoms, an aryl group having 6 to 20 carbon atoms or a heterocyclic residue of a 3- to 30-membered ring, B is selected from the group consisting of an alkyl group having 1 to 12 carbon atoms, an aralkyl group having 7 to 14 carbon atoms, an aryl group having 6 to 20 carbon atoms and a heterocyclic residue of a 3- to 30-membered ring, x is an oxygen atom or a sulfur atom, m is 1 or 2, and $R^1$ through $R^5$, A and B, may be either substituted or not substituted.

6. An electrophotographic photosensitive material as set forth in claim 5, wherein the organic photoconductor is a compound represented by the following general Formula (a):

$$R'\overset{\overset{O}{\|}}{\underset{\underset{O}{\|}}{S}}NHN{=}CH{\leftarrow}CH{=}CH{\rightarrow}_n A \qquad (a)$$

wherein A and R′ independently signify an alkyl group having 1 to 12 carbon atoms, an aralkyl group having 7 to 14 carbon atoms, an aryl group having 6 to 20 carbon atoms or a heterocyclic residue of a 3- to 30-membered ring, and wherein n is 1 or 2.

7. An electrophotographic photosensitive material as set forth in claim 5, wherein the organic photoconductor is a compound represented by the following general Formulas (b), (c) or (d):

$$A{\leftarrow}CH{=}CH{\rightarrow}_n CH{=}NNH\overset{\overset{X}{\|}}{C}NR^2R^3 \qquad (b)$$

$$A{\leftarrow}CH{=}CH{\rightarrow}_n CH{=}NNH\overset{\overset{X}{\|}}{C}N{=}CR^2R^3 \qquad (c)$$

$$A{\leftarrow}CH{=}CH{\rightarrow}_n CH{=}NNH{-}\overset{\overset{X}{\|}}{C}{-}N{=}N{\leftarrow}CH{=}CH{\rightarrow}_m B \qquad (d)$$

wherein A and B independently signify an alkyl group having 1 to 12 carbon atoms, an aralkyl group having 7 to 14 carbon atoms, an aryl group having 6 to 20 carbon atoms or a heterocyclic residue of a 3- to 30-membered ring, $R^2$ and $R^3$ either form a ring together with the nitrogen atom to which $R^2$ and $R^3$ are bonded and in this case $R^2$ and $R^3$ independently signify (1) a carbon atom, or (2) at least one atom selected from the group consisting of an oxygen atom, a nitrogen atom, and a sulfur atom which is included in the same ring, or $R^2$ and $R^3$ are not included in the same ring and in this case $R^2$ and $R^3$ independently signify a hydrogen atom, an alkyl group having 1 to 12 carbon atoms, an aralkyl group having 7 to 14 carbon atoms, an aryl group having 6 to 20 carbon atoms or a heterocyclic residue of a 3- to 30-membered ring, x is an oxygen or a sulfur atom, n is 1 or 2, and m is 1 or 2.

8. An electrophotographic photosensitive material as set forth in claim 5, wherein the organic photoconductor is a compound represented by the following general Formulas (e), (f) or (g):

$$A{\leftarrow}CH{=}CH{\rightarrow}_n CH{=}NNH\overset{\overset{X}{\|}}{C}{-}NHNR^4R^5 \qquad (e)$$

$$A{\leftarrow}CH{=}CH{\rightarrow}_n CH{=}NNH\overset{\overset{X}{\|}}{C}{-}NHN{=}CR^4R^5 \qquad (f)$$

$$A{\leftarrow}CH{=}CH{\rightarrow}_n CH{=}NNH{-}\overset{\overset{X}{\|}}{C}{-}NHN{=}CH{\leftarrow}CH{=}CH{\rightarrow}_m B \qquad (g)$$

wherein A and B independently signify an alkyl group having 1 to 12 carbon atoms, an aralkyl group having 7 to 14 carbon atoms, an aryl group having 6 to 20 carbon atoms or a heterocyclic residue of a 3- or 30-membered ring, $R^4$ and $R^5$ either form a ring together with the nitrogen atom to which $R^4$ and $R^5$ are bonded and in this case $R^4$ and $R^5$ independently signify (1) a carbon atom, or (2) at least one atom selected from the group consisting of an oxygen atom, a nitrogen atom, and a sulfur atom which is included in the same ring, or $R^4$ and $R^5$ are not included in the same ring and in this case $R^4$ and $R^5$ independently signify a hydrogen atom, an alkyl group having 1 to 12 carbon atoms, an aralkyl group having 7 to 14 carbon atoms, an aryl group having 6 to 20 carbon atoms or a heterocyclic residue of a 3- to 30-membered ring, x is an oxygen atom or a sulfur atom, n is 1 or 2, and m is 1 or 2.

9. An electrophotographic photosensitive material as set forth in claim 1, wherein the polymeric binder is a member selected from the group consisting of polyamide-imides, polyesters, polyester-amides, polycarbonates, homopolymers and copolymers of acrylic acid esters and homopolymers and copolymers of methacrylic acid esters.

10. An electrophotographic photosensitive material as set forth in claim 1, wherein the photosensitive layer is a photoconductive layer or a charge transport layer.

11. An electrophotographic photosensitive material as set forth in claim 5, wherein the polymeric binder is a member selected from the group consisting of polyamide-imides, polyesters, polyester-amides, polycarbonates, homopolymers and copolymers of acrylic acid esters and homopolymers and copolymers of methacrylic acid esters.

12. An electrophotographic photosensitive material as set forth in claim 5, wherein the photosensitive layer is a photoconductive layer or a charge transport layer.

13. An electrophotographic photosensitive material as set forth in claim 10, which has an electroconductive substrate/photoconductive layer structure, an electroconductive substrate/charge generating layer/charge transport layer structure or an electroconductive substrate/charge transport layer/charge generating layer structure.

14. An electrophotographic photosensitive material as set forth in claim 12, which has an electroconductive substrate/photoconductive layer structure, an electroconductive substrate/charge generating layer/charge transport layer structure or an electroconductive substrate/charge transport layer/charge generating layer structure.

15. An electrophotographic photosensitive material as set forth in claim 10, which has a transparent electroconductive substrate/transparent photosensitive layer/-white dielectric layer structure.

16. An electrophotographic photosensitive material as set forth in claim 12, which has a transparent electroconductive substrate/transparent photosensitive layer/-white dielectric layer structure.

17. An electrophotographic photosensitive material as set forth in claim 13, wherein each of the charge generating layers contains a charge generating material consisting of at least one compound selected from the group consisting of phthalocyanine pigments, bisazo pigments and indigo pigments.

18. An electrophotographic photosensitive material as defined in claim 1, wherein the particle diameter of the organic photoconductor is 1 μm or less.

19. The material defined in claim 18 wherein said diameter is 0.1 μm or less.

* * * * *